United States Patent [19]

Carlson et al.

[11] 4,167,924

[45] Sep. 18, 1979

[54] CLOSED LOOP FUEL CONTROL SYSTEM HAVING VARIABLE CONTROL AUTHORITY

[75] Inventors: Clifford R. Carlson, Fenton; Alan F. Chiesa, Sterling Heights, both of Mich.

[73] Assignee: General Motors Corporation, Detroit, Mich.

[21] Appl. No.: 838,629

[22] Filed: Oct. 3, 1977

[51] Int. Cl.[2] ..... F02D 5/02

[52] U.S. Cl. ..... 123/119 EC; 60/276; 60/285

[58] Field of Search ..... 123/119 EC; 60/276, 60/285

[56] References Cited

U.S. PATENT DOCUMENTS

| | | | |
|---|---|---|---|
| 3,782,347 | 1/1974 | Schmidt et al. | 60/285 |
| 3,842,600 | 10/1974 | Nakasimu et al. | 60/276 |
| 3,926,154 | 12/1975 | Williams | 60/276 |
| 3,939,654 | 2/1976 | Creps | 123/119 EC |
| 3,949,551 | 4/1976 | Eichler et al. | 60/285 |
| 4,019,470 | 4/1977 | Asano | 123/119 EC |
| 4,031,866 | 6/1977 | Asano | 60/276 |
| 4,057,042 | 4/1977 | Rono | 60/285 |
| 4,073,269 | 2/1978 | Herin et al. | 60/285 |
| 4,073,274 | 2/1978 | Saito | 60/285 |
| 4,075,982 | 2/1978 | Asano et al. | 60/285 |
| 4,085,716 | 4/1978 | Minami | 123/119 EC |
| 4,088,095 | 5/1978 | Rono | 123/119 EC |

*Primary Examiner*—Charles J. Myhre
*Assistant Examiner*—R. A. Nelli
*Attorney, Agent, or Firm*—Howard N. Conkey

[57] ABSTRACT

A closed loop fuel control system is described for a vehicle internal combustion engine which includes an exhaust gas sensor providing a signal having a value determined by the oxidizing/reducing conditions of the exhaust gases. An integral controller is responsive to the output of the exhaust gas sensor and provides a control signal varying in a first direction for sensed oxidizing/reducing conditions greater than a desired condition and varying in an opposite direction for sensed oxidizing/reducing conditions less than the desired condition. A control circuit is responsive to the output of the integral controller to adjust the vehicle engine air/fuel supply device to vary the value of the air/fuel ratio of the mixture supplied to the engine in a direction tending to maintain the desired exhaust gas condition. The output of the integral controller is limited to predetermined values so as to limit the air/fuel ratio control authority of the closed loop circuit. A circuit is described which varies the limit of the value of the output of the integral controller in a mixture leaning direction as a function of engine operating parameters related to cold engine operation so as to prevent severe excursions of the air/fuel ratio in the lean direction resulting from certain vehicle operator initiated inputs to the fuel supply device during cold engine operation.

3 Claims, 3 Drawing Figures

CLOSED LOOP FUEL CONTROL SYSTEM HAVING VARIABLE CONTROL AUTHORITY

This invention relates to a closed loop fuel control system for a vehicle internal combustion engine.

Numerous closed loop fuel control systems are known for controlling the air/fuel ratio of a mixture supplied to an internal combustion engine to a predetermined value (usually stoichiometry) in response to a sensed gas constituent in the exhaust gases of the internal combustion engine. Usually, these systems are used with a catalytic converter of the three-way type which, when the air/fuel ratio is within a narrow band near stoichiometry, is effective to oxidize CO and HC and reduce $NO_X$. These closed loop systems generally include an integrator which provides an integral correction term in response to an output of the exhaust gas sensor which varies in a direction tending to restore the air/fuel ratio to stoichiometry. These systems may or may not additionally include a proportional term.

During cold engine operation, the prior closed loop fuel control system may, in conjunction with certain operating characteristics of the engine air/fuel mixture supply means (i.e., a carburetor), cause severe excursions of the air/fuel ratio in the lean direction resulting in undesirable vehicle engine performance. For example, if the air/fuel mixture supply means is a typical carburetor having separate idle and main fuel metering, the air/fuel mixture supplied to the engine during cold engine operation when the choke is closed and the engine is at idle will generally be richer than stoichiometry resulting in the integral term of the closed loop controller adjusting the carburetor in the lean direction tending to restore a stoichiometric air/fuel ratio. During these conditions, if the vehicle operator accelerates the vehicle from idle, the carburetor operation shifts from the idle fuel metering system to the main fuel metering system. Since the idle fuel supply system generally provides a richer air/fuel mixture than the main fuel supply system, the shift to the main fuel supply system quickly provides a leaner air/fuel mixture than was provided by the idle fuel supply system. Further, the acceleration may result in the choke being blown open causing a sudden increase in the air/fuel ratio. The shift in the lean air/fuel ratio direction in conjunction with the setting of the carburetor by the closed fuel controller in the lean direction may cause a resulting severe excursion in the lean air/fuel ratio direction which may detrimentally affect the operation of the vehicle engine. The same result may occur during cold engine operation when the throttle is returned to idle from a part-open position and thereafter is again opened to provide for vehicle acceleration. When the engine is operated at part-throttle and cold, fuel in condensed form may accumulate on the manifold walls and in the carburetor. Thereafter, when the throttle valves are returned to the closed position resulting in decreased air flow and resulting in higher manifold vacuum, the fuel accumulated on the manifold walls and in the carburetor is drawn into the engine and results in a rich air/fuel mixture. The integral controller of the closed loop system responds to the resulting sensed air/fuel mixture and provides an integral term increasing in the lean direction tending to restore the air/fuel mixure to stoichiometry. If, the vehicle operator thereafter moves the throttle to an open position, the resulting decreased vacuum and increase in air flow results in an excursion of the air/fuel ratio in the lean direction. This lean excursion in conjunction with the setting of the carburetor by the closed loop fuel controller in the lean direction results in a net severe excursion in the lean direction which may detrimentally affect the vehicle engine performance.

It is the general object of the present invention to provide an improved closed loop fuel control system for controlling the air/fuel ratio of the mixture supplied to an internal combustion engine which provides improved cold engine operation.

It is another object of this invention to provide an improved closed loop fuel control system for controlling the air/fuel ratio of the mixture supplied to an internal combustion engine which limits the air/fuel ratio excursions in the lean direction during cold engine operation to values providing satisfactory cold engine performance.

It is a more specific object of this invention to provide a closed loop fuel control system for an internal combustion engine which limits the control authority of the closed loop fuel controller in the fuel mixture leaning direction as a function of sensed engine parameters relating to cold engine operation so as to prevent severe air/fuel ratio excursions in the lean direction that detrimentally affects vehicle engine operation.

These and other objects of this invention are accomplished by limiting the control authority of the closed loop controller in the fuel leaning direction as a function of sensed engine parameters relating to cold engine operation so as to limit the excursions of the air/fuel ratio in the lean direction resulting from vehicle operator initiated changes so as to provide satisfactory engine operation.

The invention may be best understood by the following description of a preferred embodiment and the drawings, in which.

Figure 1:
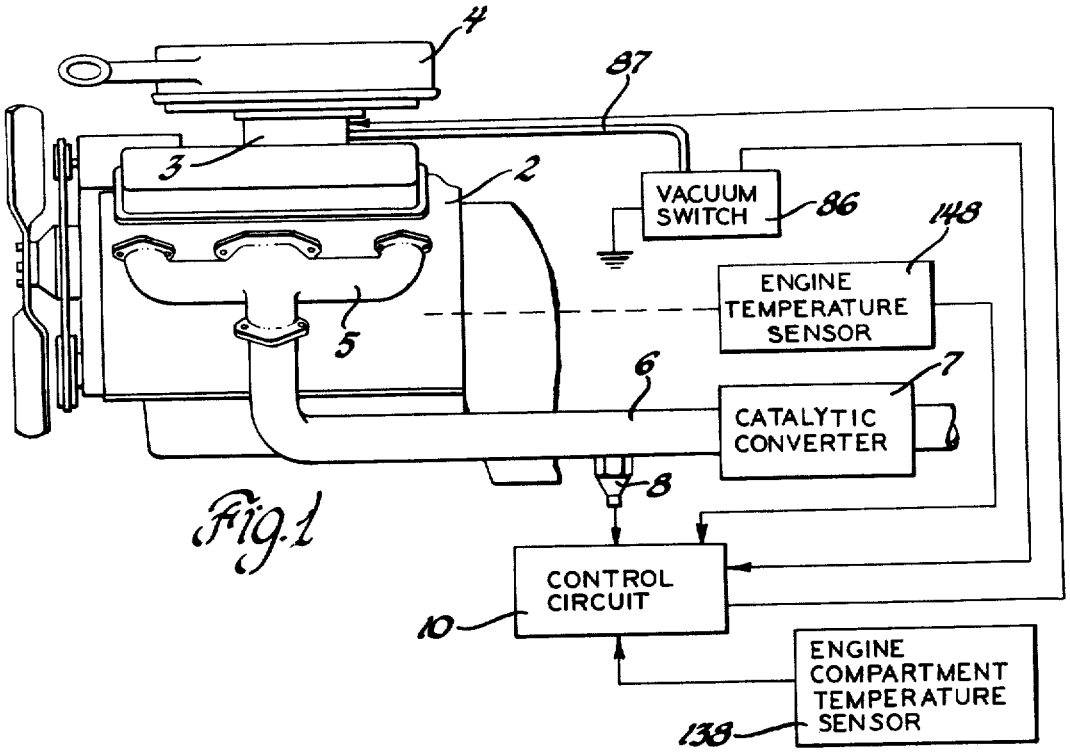
FIG. 1 is a view of an engine, exhaust system with air/fuel ratio sensor and a block diagram of a system incorporating the principles of this invention.

Referring to FIG. 1, an internal combustion engine 2 is supplied with a mixture of fuel and air from appropriate air/fuel supply means. In this embodiment, the supply means includes a carburetor 3 and an air cleaner 4 which supply an air/fuel mixture to the engine 2 although it is understood that the supply means could employ any form of apparatus for delivering an air/fuel mixture to the engine 2. For example, it is contemplated that the engine may be supplied with fuel by means of one or more fuel injectors which are controlled to provide a desired fuel flow rate.

The carburetor 3 includes a conventional cold operation enrichment device, i.e., a choke mechanism, which supplies an enriched air/fuel mixture to the engine 2 during the period of engine warmup to provide improved cold engine operating performance. The carburetor typically includes separate idle and main fuel metering means. The manner of operation of this device is well known and consequently will not be described in detail.

The air/fuel mixture supplied to the engine 2 forms a combustible mixture drawn into the respective cylinders of the engine 2 and burned, thereby producing heat which is converted to rotational energy for driving, for example, an automobile. The combustion by-products flow into exhaust manifolds such as the manifold 5 and thereafter into an exhaust conduit 6. The exhaust gas then flows through a catalytic converter 7 and thereafter is discharged into the atmosphere. The catalytic converter 7 is of the three-way type wherein carbon monoxide, hydrocarbons and nitrogen oxides can be simultaneously converted if the air/fuel mixture supplied to the catalytic converter is maintained within a narrow range at stoichiometry, the ratio containing fuel and oxygen in such proportion that, in perfect combustion, both would be completely consumed. If the air/fuel ratio deviates from stoichiometry, the converter conversion efficiency of at least one of the undesirable exhaust constituents decreases. To provide for a maximum conversion of all three of the aforementioned exhaust gas constituents, the air/fuel ratio provided by the air/fuel supply means (the carburetor 3 in the preferred embodiment) must be maintained at or near stoichiometry.

To provide for the control of the air/fuel ratio of the mixture supplied by the carburetor 3 to the engine 2 so as to obtain the desired converter conversion characteristics, the exhaust conduit 6 is provided with an oxygen sensor 8 upstream from the catalytic converter 7. The sensor 8 is preferably of the zirconia type which, when exposed to engine exhaust gases at high temperatures, e.g., 700° F., generates an output voltage which changes abruptly as the air/fuel ratio of the exhaust gases passes through the stoichiometric air/fuel ratio. Such sensors are well known in the art, a typical example being that shown in the U.S. Pat. No. 3,844,920 to Burgett et al, dated Oct. 29, 1974.

Figure 2:
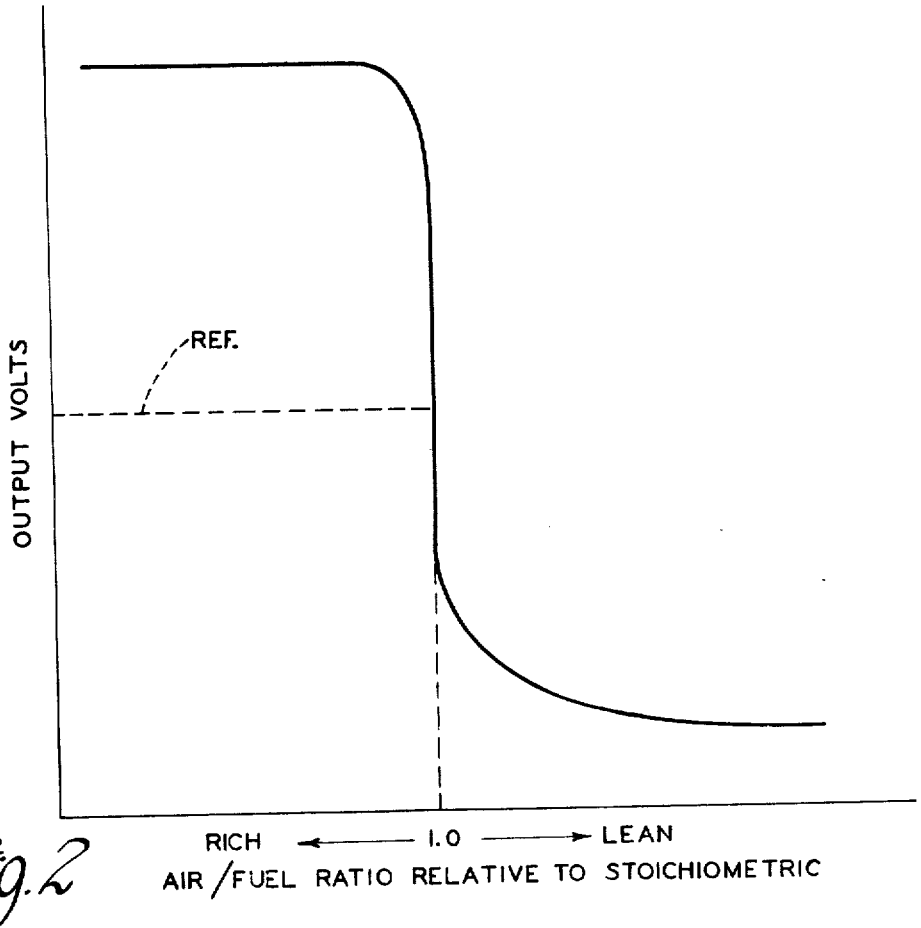
FIG. 2 is a graph illustrating a typical output signal of the air/fuel ratio sensor of FIG. 1.

FIG. 2 illustrates the output voltage of the oxygen sensor 8 as a function of the air/fuel ratio supplied by the carburetor 3. It can be seen that the voltage output of the oxygen sensor achieves its highest output level with rich air/fuel mixtures and its lowest level when the sensor is exposed to lean air/fuel mixtures. Further, it can be seen that the output voltage from the oxygen sensor 8 exhibits an abrupt change between the high and low voltage values as the air/fuel ratio mixture passes through the stoichiometric air/fuel ratio.

The carburetor 3 is generally calibrated to provide a stoichiometric air/fuel ratio. However, it is difficult to provide for air/fuel delivery means including a carburetor which has the desired response over the full range of engine operating conditions. Additionally the systems are generally incapable of compensating for various ambient conditions and fuel variations. Consequently the air/fuel ratio provided by the carburetor 3 in response to its fuel determining input parameters may deviate from stoichiometry during engine operation. To maintain the air/fuel ratio at the desired stoichiometric value, output voltage signal from the oxygen sensor 8 is supplied to a control circuit 10 which, in the manner to be described, generates a control signal in response to the sensor voltage which varies in amount and sense tending to restore the air/fuel ratio supplied by the carburetor 3 to stoichiometry. In this respect, the carburetor 3 includes an air/fuel ratio adjustment device such as illustrated in application Ser. No. 801,061, filed on May 27, 1977, that is responsive to the control signal to adjust the air/fuel ratio of the mixture supplied to the engine 2.

The control circuit 10 includes, as will be described with respect to FIG. 3, a circuit which prevents severe excursions of the air/fuel mixture in the lean direction during cold engine operation which may result in unsatisfactory engine performance when the control circuit 10 responds to a sensed rich air/fuel mixture and the mixture thereafter suddenly shifts to a lean air/fuel ratio in response to certain vehicle operator initiated inputs to the carburetor 3. This is accomplished in the preferred embodiment by variably limiting the output authority of the control circuit 10 in the direction tending to increase the air/fuel ratio mixture as a function of sensed parameters representing cold engine operation.

Figure 3:
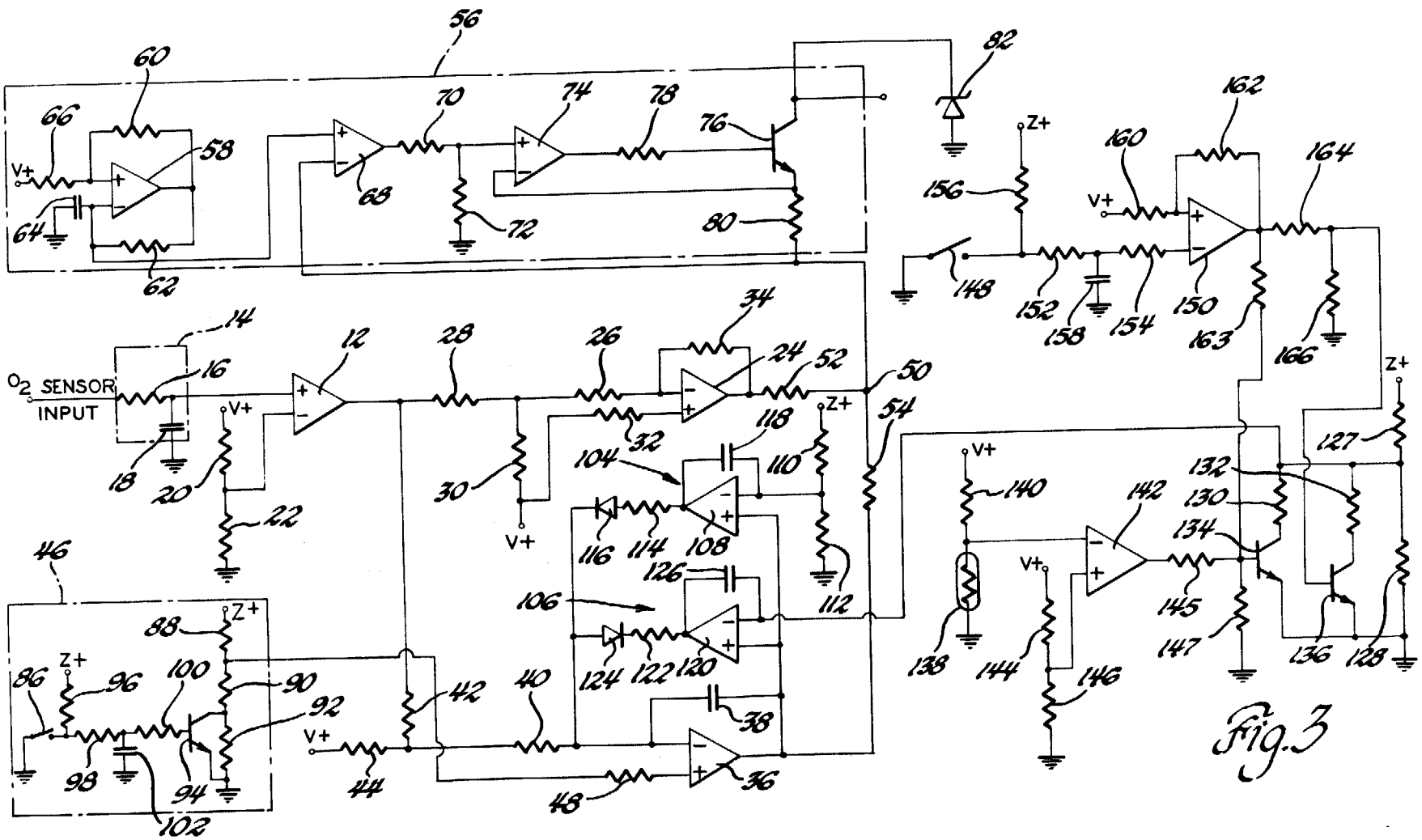
FIG. 3 is a circuit diagram of the closed loop fuel controller of FIG. 1 incorporating the principles of this invention.

Referring to FIG. 3, the output of the oxygen sensor 8 is coupled to the input of a comparator switch 12 through a high frequency filter 14 comprised of a filtering resistor 16 and filtering capacitor 18. The filter 14 functions to filter high frequency noise induced in the system from, for example, the engine ignition system. A reference voltage is provided to the negative input of the comparator switch 12 by means of a voltage divider comprised of a resistor 20 and a resistor 22 coupled between a voltage source V+ and ground. The reference voltage output between the resistors 20 and 22 has a value equal to the output voltage of the oxygen sensor 8 when the air/fuel ratio sensed thereby is stoichiometry. This reference value is illustrated in FIG. 2 and comprises a voltage level between the upper and lower levels of the output of the oxygen sensor 8. The comparator switch 12 provides an output signal which shifts abruptly between a constant low voltage level when the output of the oxygen sensor represents an air/fuel ratio greater than stoichiometry and a constant high voltage level when the output of the oxygen sensor 8 represents an air/fuel ratio less than stoichiometry.

An integral plus proportional correction term in the form of a step plus ramp is generated in response to the output of the comparator switch 12 which is effective to control the air/fuel ratio of the mixture supplied by the carburetor 3 to stoichiometry.

The proportional term is provided by an amplifier 24 and its associated circuitry. A signal that is related to the output of the comparator switch 12 is provided to the negative input of the amplifier 24 through a resistor 26. This signal is provided by a voltage divider formed by the series coupled resistors 28 and 30 coupled between the output of the comparator switch 12 and the voltage source V+. The voltage signal supplied to the negative input of the amplifier 24 has a value that is greater than the voltage value V+ when the output of the comparator switch 12 is at the positive voltage level representing a rich air/fuel ratio and is a voltage value less than the voltage V when the output of the comparator switch 12 is at its low voltage level representing a lean air/fuel mixture.

The voltage at the negative input of the amplifier 24 is compared to the voltage value V which is coupled to the positive input of the amplifier 24 through a resistor 32. A gain setting resistor 34 is coupled between the output of the amplifier 24 and its negative input.

The integral correction term is provided by an integrator which is comprised of an operational amplifier 36, a feedback capacitor 38 coupled between its output and its negative input terminal and the associated circuitry. A signal related to the output of the comparator switch 12 is provided to the negative input of the operational amplifier 36 through a resistor 40. This signal is provided by a voltage divider formed by a resistor 42 and a resistor 44 series coupled between the output of the comparator switch 12 and the voltage V+. The signal provided at the junction of the resistors 42 and 44 has a value shifting from a value greater than the voltage V+ when the output of the comparator switch 12 is at its high voltage level and a voltage level less than the value V+ when the output of the comparator switch 12 is at its low voltage level.

A reference voltage for controlling the integration constant and consequently the ramp rates of the integral term is provided by a circuit generally designated as 46 and which is coupled to the positive input of the amplifier 36 through a coupling resistor 48. This reference voltage has a value which is intermediate the voltage values provided by the voltage divider formed by the resistors 42 and 44. When the signal provided to the negative input of the amplifier 36 is at the upper voltage level when the sensed air/fuel ratio is rich, the integral term output of the amplifier 36 decreases with a constant slope determined by the difference of the voltage values provided to the positive and negative input terminals. When the voltage is at the low voltage level when the sensed air/fuel ratio is lean, the integral term output of the amplifier 36 increases with a constant slope determined by the difference between the voltage values provided to the positive and negative input terminals. When the reference voltage provided by the circuit 46 is at the midpoint between the two voltage levels provided by the voltage divider formed by the resistors 42 and 44, the positive and negative slopes of the integral term provided by the amplifier 36 are equal. However, when the reference voltage differs from the midpoint, the positive and negative slopes of the integral term at the output of the amplifier 36 varies from one another as determined by the deviation of the reference voltage from the midpoint. As will subsequently be described, the reference voltage provided by the circuit 46 is controlled in the preferred embodiment so as to provide an average air/fuel ratio of the mixture supplied to the internal combustion engine 2 to a value which is offset from the stoichiometric air/fuel ratio as sensed by the oxygen sensor 8.

The proportional plus integral correction terms are summed at a summing junction 50 through respective resistors 52 and 54. This net correction term is coupled to a voltage controlled duty cycle oscillator 56 which provides control pulses at a constant frequency but variable width to the air/fuel ratio adjustment device in the carburetor 3. In general, the duty cycle output of the circuit 56 may, for illustrative purposes, vary between 5% and 95%, an increasing duty cycle effecting a decreasing fuel flow so as to increase the air/fuel ratio and a decreasing duty cycle effecting an increase in the fuel flow so as to decrease the air/fuel ratio. The range of duty cycle from 5% to 95% may represent a change in four air/fuel ratios at the carburetor 3.

The voltage controlled duty cycle oscillator 56 generally comprises a triangular wave generator formed by an amplifier 58 having feedback resistors 60 and 62. A capacitor 64 is coupled between the negative input and ground and a resistor 65 is coupled between the voltage V+ and the positive terminal. The triangular wave output is provided at the negative input terminal of the amplifier 58 and is coupled to the positive input of a comparator switch 68. The proportional plus integral control signal from the summing junction 50 is coupled to the negative input of the comparator switch 68. The range of values of the correction term provided to the negative input of the amplifier 68 is intermediate the upper and lower voltage values of the triangular waveform so that the output of the comparator switch 68 is a duty cycle signal having a duty cycle inversely proportional to the magnitude of the proportional plus integral term. The authority of the integral plus proproportional terms are limited during normal operation so as to provide the above-mentioned range of duty cycles.

The duty cycle signal is coupled across a voltage divider formed by resistors 70 and 72 coupled between the output of the amplifier 68 and ground. The output of the voltage divider is coupled to the positive input of a switch amplifier 74 whose output is coupled to the base of an NPN transistor 76 through a resistor 78. The emitter of the transistor is coupled to ground through a resistor 80 across which a feedback signal is developed and coupled to the negative input of the switch 74. A zener diode 82 is coupled between the collector of the transistor 76 and ground. The output of the voltage controlled duty cycle oscillator 56 is provided at the collector of the transistor 76. In this respect, conduction duration of the transistor 76 has a duty cycle varying in inverse proportion to the magnitude of the proportional plus integral control signal at the summing junction 50. This duty cycle modulated signal is coupled to the controller at the carburetor 3 which functions to increase the fuel flow rate into the engine 2 with decreasing duty cycle of the output of the circuit 56 and decreases the fuel flow rate in response to increasing duty cycle output of the circuit 56. In this respect, when the air/fuel ratio as sensed by the oxygen sensor 8 is less than stoichiometry, the integral control term decreases at a constant rate to thereby increase the duty cycle of the output of the duty cycle oscillator 56 to decrease the fuel flow rate and consequently the air/fuel ratio of the mixture supplied to the engine 2. Conversely, when the oxygen sensor senses an air/fuel ratio greater than stoichiometry, the integral control term increases at a constant rate to decrease the duty cycle output of the circuit 56 which increases the fuel flow rate to thereby increase the air/fuel ratio of the mixture supplied to the internal combustion engine 2. The duty cycle output from the transistor may be inverted if the controller at the carburetor 3 is of the type that increases the air/fuel ratio with increasing duty cycle and decreases the ratio with decreasing duty cycle.

While the control system at the carburetor 3 for modifying the air/fuel ratio of the mixture supplied to the engine 2 may take any of the well known forms, it may assume the form as illustrated in the U.S. application Ser. No. 801,061, filed on May 27, 1977, which illustrates a carburetor in which the air/fuel ratio is controlled as a function of a duty cycle modulated signal. This signal energizes a solenoid valve that couples a control vacuum signal from a regulated vacuum source in accordance with the duty cycle of the signal. The control vacuum functions to position a metering rod to adjust the fuel flow.

Due to the transport delay between the supplying of an air/fuel mixture to the engine 2 and the sensing of the resulting air/fuel ratio by the oxygen sensor 8, the proportional plus integral control term causes the air/fuel ratio in the carburetor to overshoot the stoichiometric air/fuel ratio by an amount determined by the transport delay and the rate of change of the integral term of the control signal. Consequently, the system oscillates with the amplitude and frequency of the oscillation being determined by the time constants of the control system and the transport delay. When the integration rates of the integral term is the same in both the positive and negative directions, the system will oscillate in symmetrical manner about a stoichiometric air/fuel ratio as sensed by the oxygen sensor 8. However, if the rate of change in the integral control term varies as between the positive and negative directions, the average air/fuel ratio mixture supplied to the engine 2 will be offset from stoichiometry by an amount which is determined by the difference between the integration rates.

In the preferred embodiment, the reference signal supplied to the positive input of the amplifier 36 has a value such that the average air/fuel ratio during normal engine operation is greater than stoichiometry during normal engine operation and has a value such that the average air/fuel ratio of the mixture supplied to the engine 2 is less than stoichiometry during periods of, for example, heavy vehicle loading. The air/fuel ratio provided during this engine loading condition results in the increase in the conversion efficiency of the catalytic converter 7 with respect to $NO_X$ during the periods of engine loading when greater amounts of $NO_X$ are generated.

The circuit 46 provides the value of the reference signal for accomplishing the foregoing functions in response to the engine manifold vacuum. In this respect, engine manifold vacuum is coupled to a vacuum switch 86 via a tube 87 in FIG. 1. The vacuum switch 86 is open at values of manifold vacuum greater than a predetermined value such as nine inches of Hg. At pressures less than the predetermined value which is indicative of a predetermined engine loading condition, the switch 86 is closed.

Closure of the switch 86 is effective to adjust the reference signal supplied by the circuit 46 from a normal value that is less than the midpoint value between the upper and lower values of the signal between the resistors 42 and 44 to a value that is greater than the midpoint value so as to shift the average air/fuel ratio of the mixture supplied to the engine 2 from a value greater than stoichiometry (during normal engine operation) to a value less than stoichiometry (during engine loading).

The circuit 46 includes a voltage divider comprised of series coupled resistors 88, 90 and 92. The reference signal is provided between the junction of the resistors 88 and 90. An NPN transistor 94 has its emitter and collector electrodes parallel coupled with the resistor 92 such that when the transistor 94 is biased into conduction, the resistor 92 is shorted so that the output of the circuit 46 is a voltage determined by the resistors 88 and 90 and which has a value less than the midpoint value between the two voltage levels supplied to the negative input of the amplifier 36. When the transistor 94 is biased nonconductive, the output of the circuit 46 is a voltage determined by the resistors 88, 90 and 92 and which has a value greater than the midpoint value between the two voltage levels supplied to the negative input of the amplifier 36. A regulated voltage Z+ is coupled to the base of the transistor 94 through a resistor 96, a resistor 98 and a resistor 100. A capacitor 102 has one side coupled between the resistors 98 and 100 and ground potential and functions with the resistors to form a delay circuit. The vacuum switch 86 is coupled between ground and the junction between the resistors 96 and 98 and controls the conduction of the transistor 94 and therefore the voltage output of the circuit 46.

When the vacuum switch 86 is in its open position representing a manifold vacuum greater than the predetermined level, (nine inches of mercury in the preferred embodiment) the voltage Z+ is coupled to the base of the transistor 94 which is biased conductive so that the reference voltage is less than the midpoint of the voltage values of the input to the negative terminal of the amplifier 36. As previously indicated, this results in asymmetrical ramp rates of the integral term provided by the amplifier 36 resulting in an average air/fuel ratio greater than stoichiometry. However, during periods of engine loading where the manifold vacuum is less than the predetermined level, the vacuum switch is closed to ground the input to the base of the transistor 94 which is biased nonconductive. The reference voltage therefore increases to the level greater than the midpoint between the high and low voltage levels supplied to the negative input of the amplifier 36. This results in an asymmetrical waveform output of the amplifier 36 providing an average rich air/fuel ratio of the mixture supplied to the engine 2.

The authority of the integral plus proportioned correction term is such that the duty cycle output of the duty cycle oscillator 56 varies between predetermined limits, such as 5% and 95% in the preferred embodiment, where a duty cycle of 50% may effect no adjustment of the air/fuel ratio provided by the carburetor 3. The authority limits are set by a limiting circuit 104 which limits the maximum value of the integral term output of the amplifier 36 (rich authority limit) and a limiting circuit 106 which limits the minimum value of the integral control term (lean authority limit).

The limiting circuit 104 includes an operational amplifier 108. The integral control term output of the amplifier 36 is coupled to the positive input of the amplifier 108 and a reference voltage is applied to the negative terminal by a voltage divider comprised of a resistor 110 and a resistor 112 series coupled between the regulated voltage Z+ and ground. The values of the resistors 110 and 112 are selected so that the reference voltage supplied thereby represents the maximum desired value of the integral control term. This value corresponds to a value of the integral control term resulting in a proportional plus integral control signal producing a duty cycle of 5% at the output of the duty cycle oscillator 56. The output of the amplifier 108 is coupled to the negative input of the amplifier 36 through a resistor 114 and a diode 116. A capacitor 118 is coupled between the negative input of the amplifier 108 and its output to form an integrator.

When the output of the comparator switch 12 is at its low level representing a sensed lean air/fuel ratio, the output of the amplifier 36 increases in a ramp fashion to decrease the duty cycle output of the oscillator 56 so as to effect a decrease in the air/fuel ratio of the mixture supplied by the carburetor 3. If the integral control term attains a magnitude greater than the reference value provided by the resistors 110 and 112, the output of the amplifier 108 increases in the positive direction to supply current to the negative input of the amplifier 36.

An equilibrium is reached at which the inputs to the negative and positive inputs of the amplifier 36 are equal and the output thereof remains constant at the value of the reference voltage provided by the resistors 110 and 112.

The limiting circuit 106 similarly functions to limit the lower value of the integral control term. In this respect, the limiting circuit 106 includes an operational amplifier 120 which receives the integral control term output of the amplifier 36 at its positive input. The output of the amplifier 120 is coupled to the negative input of the amplifier 36 through a resistor 122 and a diode 124 poled to conduct current away from the negative terminal of the amplifier 36. The amplifier 120 includes a feedback capacitor 126 coupled between its negative input and its output so as to form an integrator. A reference voltage is applied to the negative input of the amplifier 120 in accordance with the principles of this invention by a reference generating circuit to be described. When the integral control term decreases to a value below the reference value, the output of the amplifier 120 decreases to conduct current away from the negative input of the amplifier 36. An equilibrium is reached where the inputs to the negative and positive terminals of the amplifier 36 are equal and where the amplifier 36 output is equal to the reference voltage provided to the amplifier 120. In this manner, the control authority of the integral control term in the lean controlling direction is established.

Under normal warm engine operating conditions, the minimum value of the integral control term establishing the lean authority limit is limited to a predetermined value which, in the preferred embodiment, is a value producing a duty cycle of 95% at the output of the duty cycle oscillator 56. However, as previously described, during cold engine operation, certain conditions in the fuel delivery system may cause the integral control term to approach or reach the lean authority limit thereby adjusting the carburetor 3 in the lean direction tending to obtain a stoichiometric air/fuel ratio. This condition is generally associated with an idle condition. Thereafter, when the throttle is opened, a substantially lean air/fuel mixture is supplied to the engine which, in conjunction with the lean adjustment of the carburetor 3 results in a severe excursion of the air/fuel ratio in the lean direction which may severelyaffect engine performance or may result in an engine stall. As the temperature of the engine and carburetor 3 increases with the opening of the choke and with improved fuel vaporization, the lean air/fuel ratio excursion resulting when the throttle is opened decreases. To insure satisfactory engine operation during cold engine operation, the present invention limits the lean authority of the integral control term as a function of parameters relating to cold engine operation so as to limit the value of the aforementioned lean air/fuel ratio excursions to values which do not seriously affect engine performance.

The circuit of FIG. 3 includes a reference signal generator which variably limits the authority of the integral control term output of the amplifier 120 in the lean direction in step fashion in response to specified combinations of vehicle operating parameters to values designed to insure satisfactory cold engine operation while yet not inhibiting the controller in its operation in the fuel enrichment direction.

The reference signal supplied to the negative input of the amplifier 120 is provided by means of a voltage divider coupled between the voltage Z+ and ground. The voltage divider includes a resistor 127 series coupled with a resistor 128. A pair of resistors 130 and 132 are each parallel coupled with the resistor 128 through switching devices illustrated as NPN transistors 134 and 136. When both of the transistors 134 and 136 are conducting (during warm engine operation as will hereinafter be described) the reference voltage supplied to the negative input of the amplifier 120 is substantially equal to the value of the integral control term which results, in the preferred embodiment, in a 95% duty cycle output of the duty cycle oscillator 56. Consequently, the authority of the closed loop controller in the leaning direction is limited to the air/fuel ratio produced by the 95% duty cycle output of the duty cycle oscillator 56.

The reference signal supplied to the negative input of the amplifier 120 is selectively varied in response to two vehicle operating parameters in the preferred embodiment that are related to cold engine operation so as to variably limit the response of the closed loop controller to a sensed rich air/fuel ratio provided by the carburetor 3 during cold engine operation. This is accomplished by selectively controlling the conduction of the transistors 134 and 136 in response to the two engine operating parameters which, in the preferred embodiment, are engine temperature and the ambient temperature within the engine compartment, both of which are indicative of the magnitude of the lean air/fuel ratio excursion when the carburetor is operated from an idle position.

The engine compartment temperature is sensed by a temperature sensor illustrated as a thermistor 138 which is mounted within the engine compartment and whose resistance is inversely proportional to the sensed temperature. The thermistor 138 forms one resistor of a voltage divider including a resistor 140 coupled between the voltage V+ and ground. The output of the voltage divider across the thermistor 138 is coupled to the negative input of a comparator switch 142. A reference voltage is applied to the positive input of the switch 142 by means of a voltage divider comprised of a resistor 144 and a resistor 146 coupled between the voltage V+ and ground. This reference value is such that it is less than or equal to the voltage drop across the thermistor 138 when the temperature of the engine compartment is representative of cold engine operation. This temperature, for illustration purposes, may be 60° F. When the sensed temperature is below the reference temperature, the output of the comparator switch 142 is substantially ground potential. When the temperature of the engine compartment exceeds the reference temperature, the output of the comparator switch 142 is a positive voltage level. The output of the comparator switch 142 is coupled across a pair of series coupled resistors 145 and 147 the voltage developed therebetween being coupled to the base of the transistor 134. The transistor 134 is biased nonconductive when the sensed temperature of the engine compartment is below the reference temperature indicative of cold engine operation and is biased conductive when the temperature exceeds the reference temperature. When the transistor 134 is conducting, the resistor 130 is parallel coupled with the resistor 128.

The engine temperature is provided by an engine block temperature switch 148 which is coupled between ground and the negative input of an amplifier 150 through a resistor 152 and a resistor 154. The regulated voltage Z+ is coupled to the negative input of the amplifier 150 through a resistor 156 and the resistors 152 and 154. A capacitor 158 is coupled between ground and the junction between the resistors 152 and 154. The voltage V+ is coupled to the positive input of the amplifier 150 through a resistor 160. A gain setting feedback resistor 162 is coupled between the positive input of the amplifier 150 and its output. The output of the amplifier 150 is coupled to the base of the transistor 134 through a resistor 163 and across a voltage divider formed by a resistor 164 and a resistor 166. The junction between the resistors 164 and 166 is coupled to the base electrode of the transistor 136.

When the engine block temperature is below a value indicative of cold engine operation, such as 150° F., the switch 148 is in its open state and the voltage Z+ is coupled to the negative input of the amplifier 150 whose output is at a low voltage level. When the engine temperature attains the predetermined temperature, i.e., 150° F., the temperature switch 148 closes and grounds the negative input of the amplifier 150 whose output shifts to a positive voltage level to bias each of the transistors 136 and 134 conductive.

The voltage across the parallel combination of the resistors 128, 130 and 132 is coupled to the negative input of the amplifier 120.

The values of the resistors 128, 130 and 132 are such that when the transistors 136 and 134 are both biased conductive, the voltage applied to the negative input of the amplifier 120 is equal to the value of the integral control term resulting in a 95% duty cycle output of the duty cycle oscillator 56. However, when the outputs of the amplifiers 142 and 150 are both at the low level representing cold engine operation, the transistors 134 and 136 are biased nonconductive and the voltage applied to the negative input of the amplifier 120 is equal to the integral control term producing a duty cycle of, for example, 50%. Therefore, when each of the temperature sensors 138 and 148 represent cold engine operation, the response of the integral controller to the sensed air/fuel ratio is limited in the leaning direction to a value resulting in a 50% duty cycle output of the circuit 56 to thereby limit the operation of the system for controlling the carburetor in the lean direction. This limit is determined to be sufficient to limit the value of the air/fuel ratio in the lean direction during the lean excursion resulting from the operation of the throttle from idle to a value which would produce satisfactory engine operation. However, if the ambient temperature in the engine compartment attains or is at the predetermined value, i.e., 60° F., while the sensor 148 represents cold engine operation, the transistor 134 is biased conductive to couple the resistor 130 in parallel with the resistor 128 to shift the reference voltage applied to the negative input of the amplifier 120 to a value equal to the integral control term causing a duty cycle output of the circuit 56 of, for example, 75%. The integral control term is therefore allowed to ramp in the mixture leaning direction to provide for an increase in the air/fuel ratio that is greater than the air/fuel ratio limit when both sensed temperatures represents cold operation. This increased authority in the mixture leaning direction is provided since the lean excursion that occurs when the throttle is opened is less severe at higher ambient temperatures.

When the engine block attains the predetermined temperature value where the fuel vaporization has improved so that the lean excursion in the air/fuel ratio as the throttle is opened is minimal, each of the transistors 134 and 136 are biased conductive so as to provide the reference signal to the amplifier 120 which is equal to the integral control term producing a fuel lean authority 95% duty cycle of the signal output of the duty cycle oscillator 56. The control circuit of FIG. 3 is then allowed to operate over its full range of authority in response to the sensed exhaust gas conditions by the sensor 8.

Additional parameters may be sensed and additional limit levels may be established as a function of the state of the sensed parameters to obtain the desired cold engine operating performance. Many equivalent embodiments will occur to those skilled in the art. The invention is therefore limited only by the claims which follow.

The embodiments of the invention in which an exclusive property or privilege is claimed are defined as follows:

1. A fuel control system for an internal combustion engine comprising:

an air/fuel mixture supply means having supply characteristics during cold engine operation producing lean air/fuel excursions having a value related to the degree of engine operating temperature;

a closed loop fuel control circuit for controlling the air/fuel ratio to a predetermined ratio, said control circuit including means responsive to the content of the exhaust gas output of the internal combustion engine effective to generate an air/fuel ratio signal related to the value of the ratio of the air/fuel mixture, an integrator responsive to the air/fuel ratio signal effective to provide a control signal having a value varying in a first direction when the air/fuel ratio signal represents a ratio greater than said predetermined ratio and varying in an opposite direction when the air/fuel ratio signal represents a ratio less than said predetermined ratio, control means effective to control the air/fuel ratio of the mixture supplied by the air/fuel mixture supply means in accord with the instantaneous value of the control signal to obtain the predetermined ratio, means effective to limit the value of the control signal in each direction to predetermined values to limit the air/fuel ratio control authority of the closed loop fuel control circuit; and means cooperating with the closed loop fuel control circuit effective to provide improved cold engine operating performance, said last mentioned means including means responsive to at least one vehicle operating parameter related to cold engine operation effective to vary the limit of the value of the control signal provided by the integrator in said opposite direction to an intermediate value when said operating parameter represents cold engine operation so as to decrease the limit of the control authority of the control means in said opposite direction tending to increase the air/fuel ratio to limit the value of the air/fuel ratio during the lean air/fuel excursions during cold engine operation to thereby limit the affect of said excursions on the cold engine operating performance.

2. A fuel control system for an internal combustion engine having combustion space into which an air/fuel mixture is supplied to undergo combustion and having means defining an exhaust gas passage from the combustion space into which spent combustion gases are discharged and are directed to the atmosphere, comprising, in combination:

an air/fuel mixture supply means having supply characteristics during cold engine operation producing lean air/fuel excursions having a value related to the degree of engine operating temperature;

a sensor responsive to the oxidizing/reducing conditions at a predetermined point in the exhaust passage, and hence to the mixture supplied to the combustion space, the sensor having an output condition indicative of the oxidizing/reducing conditions in the exhaust passage;

a control circuit responsive to the output condition of the sensor effective to provide a control signal having a value varying in a mixture leaning direction when the sensor output condition varies in a first sense from a predetermined condition representing a rich air/fuel mixture and varying in mixture enrichment direction when the sensor output condition varies in an opposite sense from the predetermined condition representing a lean air/fuel mixture;

means effective to control the air/fuel ratio of the mixture supplied to the engine by the air/fuel mixture supply means in accord with the instantaneous value of the control signal;

means effective to limit the value of the control signal in each direction to predetermined values to limit the control authority of the control circuit; and means effective to provide improved cold engine operating performance, said last mentioned means including means responsive to at least two vehicle operating parameters related to cold engine operation effective to vary the limit of the value of the control signal in said mixture leaning direction to a first intermediate value in response to a first combination of said operating parameters representing a first degree of cold engine operation and to a second intermediate value between the first intermediate value and said predetermined value in response to a second combination of said operating parameters representing a second degree of cold engine operation so as to selectively vary the control authority of the control circuit in said mixture leaning direction to limit the value of the air/fuel ratio during the lean air/fuel excursions during cold engine operation in accord with the degree of engine operating temperature to thereby limit the affect of said excursions on the cold engine operating performance.

3. A fuel control system for an internal combustion engine comprising:

an air/fuel mixture supply means; and a closed loop fuel controller for controlling the air/fuel ratio of the air and fuel mixture to a predetermined ratio, said closed loop fuel controller including a sensor responsive to the condition of the exhaust gas output of the internal combustion engine effective to generate an air/fuel ratio signal related to the value of the ratio of the air/fuel mixture, means responsive to the air/fuel ratio signal effective to provide a control signal having a value varying in a first direction when the air/fuel ratio signal represents a ratio greater than said determined ratio and varying in an opposite direction when the air/fuel ratio signal represents a ratio less than said predetermined ratio, means effective to adjust the air/fuel ratio of the mixture supplied by the air/fuel mixture supply means in accord with the value of the control signal to obtain the predetermined ratio, means effective to limit the value of the control signal in each direction to respective predetermined values to limit the air/fuel ratio control authority of the closed loop fuel controller, means effective to sense an engine operating parameter related to engine temperature, and means responsive to the value of the sensed engine operating parameter effective to vary the limit of the value of the control signal in said opposite direction in accord with the engine temperature so as to decrease the limit of the control authority of the controller in said opposite direction during cold engine operation.

* * * * *